US007172455B2

(12) United States Patent
Pabst et al.

(10) Patent No.: US 7,172,455 B2
(45) Date of Patent: Feb. 6, 2007

(54) PLUG-IN CONNECTOR FOR CONNECTING TWO FLAT STRIP CONDUCTORS AND ASSOCIATED PLUG-IN CONNECTOR SYSTEM

(75) Inventors: Thomas Bernhard Pabst, Röthenbach a.d. Pegnitz (DE); Hans-Otto Geltsch, Berg-Sindlbach (DE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/531,336

(22) PCT Filed: Oct. 30, 2003

(86) PCT No.: PCT/EP03/12088

§ 371 (c)(1),
(2), (4) Date: Apr. 14, 2005

(87) PCT Pub. No.: WO2004/040700

PCT Pub. Date: May 13, 2004

(65) Prior Publication Data

US 2006/0148308 A1 Jul. 6, 2006

(30) Foreign Application Priority Data

Oct. 31, 2002 (DE) ..... 102 50 929

(51) Int. Cl.
*H01R 12/24* (2006.01)

(52) U.S. Cl. ..... 439/496; 439/499

(58) Field of Classification Search ..... 439/496, 439/495, 492, 67, 499, 329
See application file for complete search history.

(56) References Cited

U.S. PATENT DOCUMENTS

| | | | | |
|---|---|---|---|---|
| 3,065,446 | A * | 11/1962 | Langzettel et al. | 439/496 |
| 3,082,398 | A | 3/1963 | Valach | 339/176 |
| 3,366,919 | A | 1/1968 | Gammel, Sr. et al. | 339/176 |
| 4,802,866 | A * | 2/1989 | Balzano et al. | 439/496 |
| 4,900,269 | A | 2/1990 | Lynch | 439/499 |
| 5,397,247 | A * | 3/1995 | Aoki et al. | 439/496 |
| 6,080,006 | A | 6/2000 | Broder | 439/409 |
| 6,299,469 | B1 | 10/2001 | Glovatsky et al. | 439/329 |
| 6,464,534 | B1 | 10/2002 | Schramme et al. | 439/492 |

FOREIGN PATENT DOCUMENTS

| | | |
|---|---|---|
| DE | 1 440 842 | 11/1968 |
| DE | 1 640 848 | 12/1970 |
| DE | 198 32 011 A1 | 2/2000 |
| DE | 100 01 956 C1 | 10/2001 |
| DE | 102 50 929 A1 | 5/2004 |
| EP | 1 039 791 A1 | 9/2000 |
| EP | 1 195 852 A1 | 4/2002 |
| FR | A 1 236 251 | 9/1959 |
| FR | 1289174 | 12/1962 |
| WO | WO 02/13316 A1 | 2/2002 |

* cited by examiner

*Primary Examiner*—Felix O. Figueroa
(74) *Attorney, Agent, or Firm*—Harrington & Smith, LLP

(57) ABSTRACT

The invention relates to a plug-in connector for connecting two flat strip conductors, including at least one spring element which provides the required normal contact power for the connection of the two flat strip conductors. The spring element contacts the two flat strip connectors and produces the electric contact between the two flat strip connectors.

9 Claims, 15 Drawing Sheets

PLUG-IN CONNECTOR FOR CONNECTING TWO FLAT STRIP CONDUCTORS AND ASSOCIATED PLUG-IN CONNECTOR SYSTEM

FIELD OF THE INVENTION

The present invention relates to a plug connector for connecting two ribbon conductors as well as a plug connector system.

BACKGROUND OF THE INVENTION

Ribbon conductors are finding an ever broader field of application in many fields of technological use, because, with them, it is possible to construct, in a simple way, preformed wiring sets that can be installed simply and rapidly during assembly. One field of application of these ribbon conductors is increasingly the motor vehicle industry, because, owing to the use of many electronic components in vehicles, the resulting flows of current are becoming increasingly large. The larger conductor cross section required for a larger current flow can be accommodated in the case of ribbon conductors by the width of the conductive track.

When two ribbon conductors are connected, among other things, spring elements are used, which are arranged in such a way that they afford the normal contact force between the two ribbon conductors required for the contact.

Known from FR A 1,236,251 is a plug connector for connecting two ribbon conductors, wherein each ribbon conductor is held in place in a respective holder, which has a spring element by means of which the ribbon conductor is clamped. In this plug connector, however, each of the ribbon conductors stripped of insulation lies on its respective holder with its contact surface exposed.

Known from DE 198 32 011 A1 is a junction region for connecting two ribbon conductors, in which one of the ribbon conductors is arranged in the interior of the housing of this junction region around a holder that can be shifted in the housing. This holder has spring elements that press one ribbon conductor against the other ribbon conductor in order to produce the requisite normal contact force. This junction region is complicated and costly in terms of its overall construction with its shiftable holder, because an adjusting mechanism that can pivot and produces the requisite normal contact force is provided.

Of crucial importance for good electrical contact is the contact resistance between the two ribbon conductors at the contacting site as well as the normal contact force exerted at this contacting site. Depicted in FIGS. 1 and 2 are the curves of measurements, carried out by the applicant, that are concerned with these crucial decision-making parameters.

Plotted in FIG. 1 is the contact resistance between two conductive tracks as a function of the normal contact force applied for a flexible ribbon conductor with a thickness of 200 μm. As is evident from this figure, the contact resistance is constant starting from a normal contact force of approximately 2 N and does not become any smaller. It can be concluded from this that a normal contact force of ≧2 N minimizes the contact resistance between two conductive tracks. Plotted in FIG. 2 is the plastic deformation of conductive tracks of 100 μm and 200 μm thickness that results when a test ball with a diameter of 2 mm is pressed with a certain test force on the stripped bare copper conductive track. As is evident from the two measurement curves represented, there results a detectable plastic deformation for a ball diameter of 2 mm only above a force of approximately 2 N at a conductor thickness of 100 μm and only above a force of 4 N at a conductor thickness of 200 μm. It can be concluded from the measurement curves shown in FIGS. 1 and 2 that the connection of two ribbon conductors is readily possible given a proper placement of the contact sites and that the normal contact force should lie at approximately 2 to 4 N depending on the thickness of the conductive tracks.

SUMMARY OF THE INVENTION

The object of the present invention is to create a connection between two ribbon conductors that fulfills the above requirements of normal contact force and that, at the same time, has a simple and cost-effective construction and makes possible a simple connection between the two conductors.

This object is fulfilled by a plug connector in accordance with independent patent claim 1.

This object is also fulfilled by a plug connector system in accordance with claim 10.

In accordance with the invention, the plug connector for connecting two ribbon conductors has at least one spring element, which affords the requisite normal contact force for the connection of the two ribbon conductors, the spring element contacting the two ribbon conductors and producing the electrical connection between the two ribbon conductors. Owing to the fact that the spring element contacts the two spring elements[1] directly, it is possible, through the construction of the spring element, to adjust the requisite normal contact force in a simple way.

[1] [Translator's Note]: sic; presumably, "the two ribbon conductors" is meant.

In a preferred embodiment, the spring element is joined in a fixed manner to the first ribbon conductor; for example, it can be soldered in place on the first ribbon conductor. Here, the first ribbon conductor is preferably arranged on a printed circuit board, the ribbon conductor forming the conductive tracks of the circuit board.

Furthermore, the plug connector can have an uptake for an inserted unit on which the second ribbon conductor is held in place. This inserted unit with the ribbon conductor held in place on it is inserted into the plug connector so that the spring element can contact the conductive tracks of the second ribbon conductor when the latter is inserted into the plug connector.

Preferably, the uptake has channels, which are separated from one another by ribs and in each of which a spring element is arranged. Through this arrangement, it is possible to arrange the spring elements used for the electrical connection in a simple way in the uptake.

Furthermore, the spring element preferably has a free end, which is bent back in the direction of insertion of the inserted unit. When the inserted unit, with the second ribbon conductor held in place on it, is inserted, the spring element touches the contact surface of the second ribbon conductor stripped of insulation.

Furthermore, the inserted unit can have a raised part in the direction of insertion in front of the spring element, this raised part forming a stop for the spring element. At the same time, when the inserted unit is not inserted, this raised part affords a protection for the spring element in the uptake, because, when the plug connector is arranged on the circuit board with the ribbon conductor, the spring element is poorly accessible from the outside and thus cannot be bent or damaged.

In a preferred embodiment, the inserted unit has, once again, a ribbed structure, in which the spring element engages and contacts the second ribbon conductor held in place on the inserted unit. The spring element is guided by this ribbed structure during insertion of the inserted unit into the plug connector and a successful contacting between the spring element and the second ribbon conductor is ensured. Owing to the ribbed structure, the contact region of the second ribbon conductor is also protected against damage due to improper use by a user when the inserted unit does not yet lie in the plug connector and the contact region of the second ribbon conductor would otherwise by freely accessible and unprotected.

The problem of the invention is further solved by a plug connector system for connecting two ribbon conductors, which has a first holder, on which the first ribbon conductor is held in place, and a second holder, on which the second ribbon conductor is held in place and which has a spring element that affords the requisite normal contact force for connecting the two ribbon conductors. The first holder has, in accordance with the invention, a comb structure, the first ribbon conductor being laid around teeth of the comb structure that engage between the ribs formed on the second holder and thus connect the two ribbon conductors with each other. This arrangement affords a secure and simple connection of the individual conductive tracks with the requisite normal contact force.

Preferably, the at least one spring element is arranged each time in at least one recess formed in the second holder. Furthermore, the second ribbon conductor can be arranged between the spring element arranged in the recess and the ribs, so that the spring element presses the second ribbon conductor against the ribs. The ribbon conductors lying around the teeth of the comb structure each engage between two ribs and contact the ribbon conductor that is pressed from below by the spring element against the ribs. In this way, a non-slipping, simple contacting of the ribbon conductors is achieved.

Preferably, one conductive track of the first ribbon conductor lies around each tooth of the comb structure, a shoulder for guiding the respective conductive track being formed between the teeth.

In order to hold in place the first ribbon cable in the first holder, the latter has a cross piece running transverse to the conductive tracks and a hinge that can swing from a pre-locking position to a final locking position, this hinge at the same time holding in place the end of the ribbon cable in the final locking position. In this way, it is possible to lay the end of the ribbon cable stripped of insulation around the teeth of the comb structure in a simple manner and, at the same time, to achieve a strain relief for the cable, which arises owing to the fact that the cable is held in place between the cross bar and the hinge.

Provided in a preferred embodiment between every two ribs of the second holder is a respective spring element, and each of these presses a conductive track of the second ribbon conductor in the direction of the first ribbon conductor placed around the teeth. Achieved in this way is the optimal normal contact force for each individual conductive track.

BRIEF DESCRIPTION OF THE DRAWINGS

The invention will be described in detail below with reference to the attached drawings.

DETAILED DESCRIPTION OF THE INVENTION

Figure 1A:
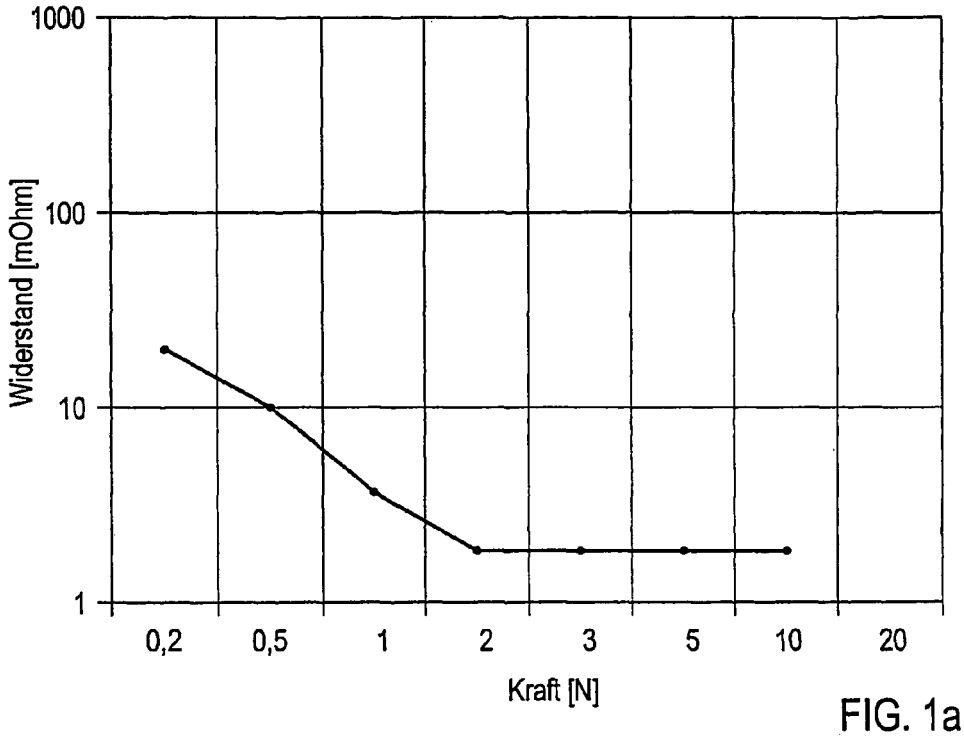
FIGS. 1*a* and 1*b* show the relation between the contact resistance and the normal contact force for the connection of two conductors as well as the penetration depth of a test ball for two different conductor thicknesses as a function of the applied force.
Figure 1B:
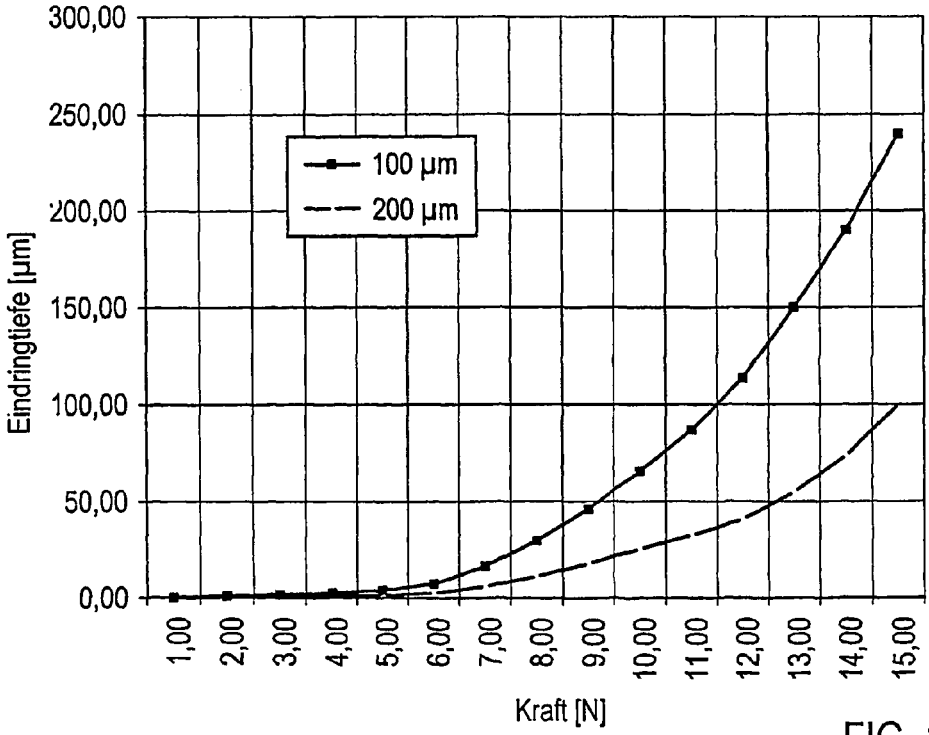
Figure 2:
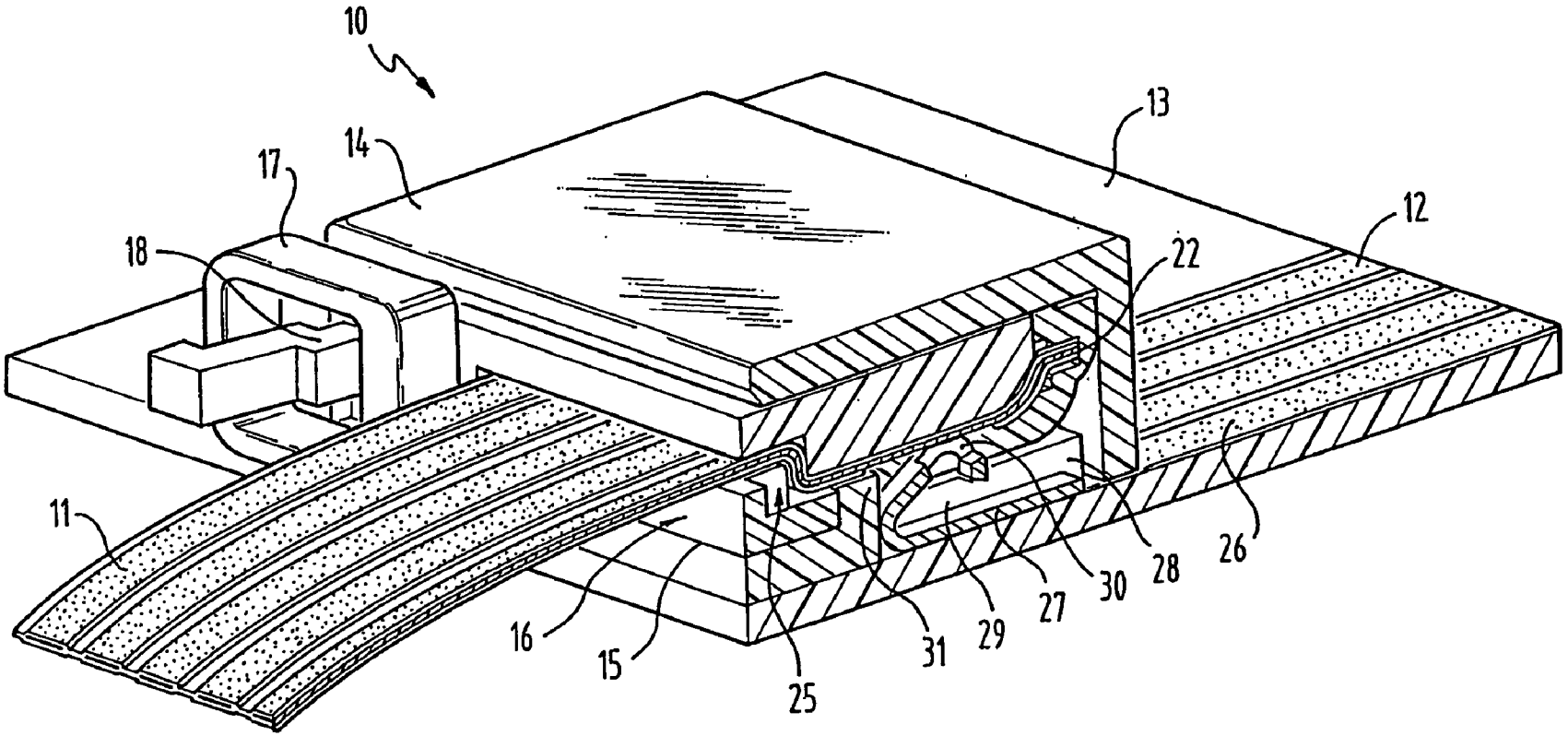
FIG. 2 shows an oblique view of a plug connector according to a first embodiment of the invention.

FIG. 2 shows a plug connector 10, which connects a first conductor 12 to a second conductor 11. The second conductor 11, in the present example, is a flexible ribbon conductor and the conductor 12, in the present example, is arranged on a circuit board 13. The second conductor 12 does not necessarily need to be arranged on a circuit board, but can also be arranged on any other support, which, in the present embodiment example, is preferably rigid. The plug connector 10 has a housing 14 with an opening 15, which forms an uptake for an inserted unit 16 (see FIGS. 3*a* and 3*b*), which can be attached by means of a catch 17 on the housing 14 of the plug connector 10. The inserted unit further has a coding 18 so that the inserted unit is not inserted into the housing from the wrong side.

Figure 3A:
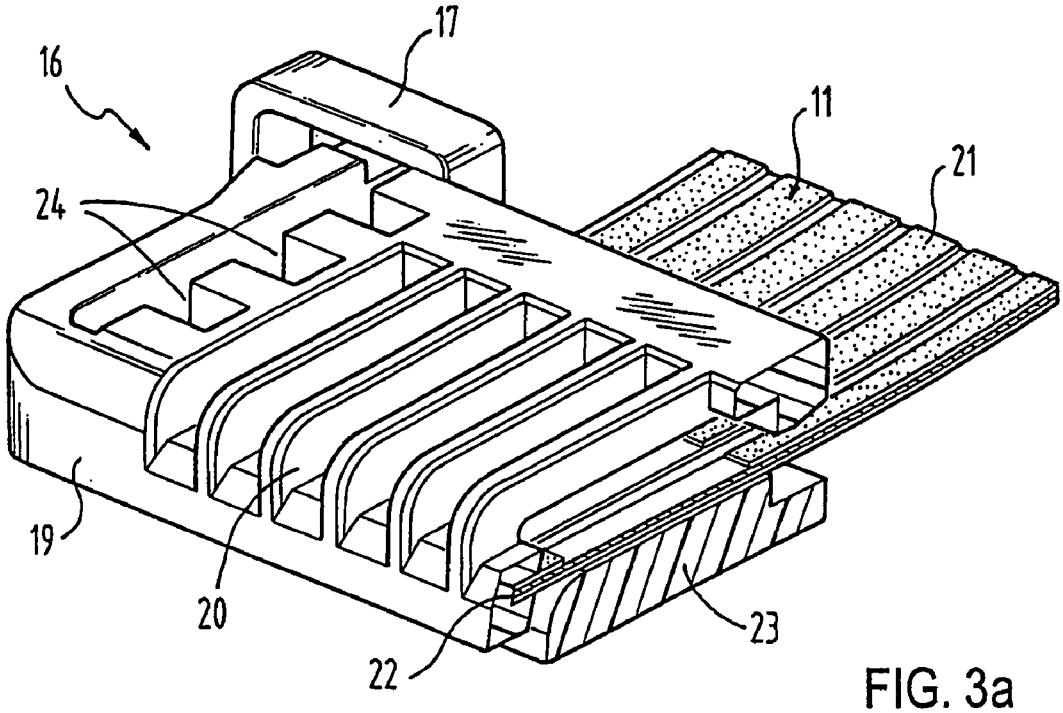
FIGS. 3*a* and 3*b* show the inserted unit of the plug connector used in FIG. 2 in a pre-locked position and in a final locked position.

As is evident in FIG. 3*a*, the inserted unit 16 has a housing 19 made of insulating material, on the top side of which a ribbed structure 20 is formed. The second ribbon conductor 11 is inserted with its conductive tracks 21, which have been stripped of insulation at the front end, up to a terminal stop 22 into the housing 19 and held in place therein by a retaining plate 23.

Represented in FIG. 3*a* is the retaining plate in the pre-locked position. It has catches (not shown), with which it is positioned on grooves 24 formed on the housing 19.

Figure 3B:
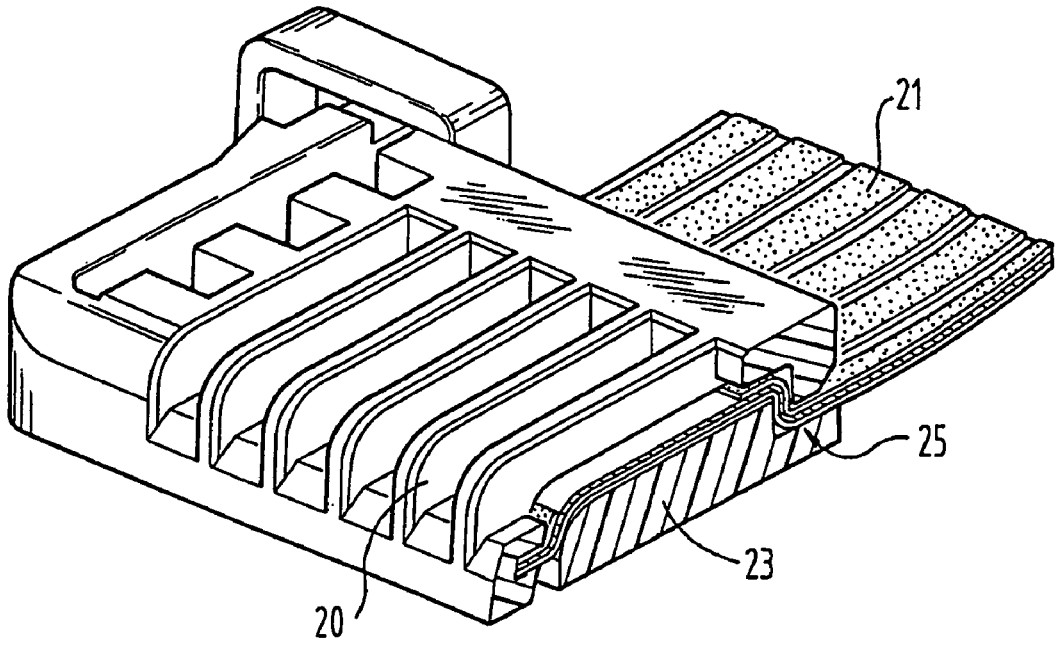

Represented in FIG. 3*b* is the retaining plate 23 in the final locked position, the conductive tracks 21 now being pressed by the retaining plate 23 from below against the ribbed structure 20. The ribbed structure 20 forms, at the same time, a protection of the conductive tracks stripped of insulation, because, owing to handling by a user, these tracks cannot be touched and thereby cannot be contaminated or damaged. In the final locked position, the retaining plate 23 with the housing 19 at the back end forms a strain relief 25 for the second ribbon conductor 11. As represented in FIG. 2, the inserted unit 16 is now inserted into the housing 14 of the plug connector 10, whereby a spring element 27 arranged in fixed position on the conductive track 26 of the first ribbon conductor 12 electrically connects the first conductor 12 with the second conductor 11. The spring element can, for example, be soldered on the first conductor 12. The spring element is arranged in channels 29 of the housing 14, these channels being formed by ribs 28, the free end 30 of the spring element 27 being bent back and forming the contact surface with the ribbon conductor 11. The channel 29 formed for receiving the spring element 27 is bounded at the front end by a raised part 31, which forms a stop for the spring element 27 and, at the same time, when the inserted unit 16 is not inserted, affords a protection for the spring element.

The plug connector represented in FIGS. 2 and 3 affords a plug connector with good long-term stability, for which, owing to the construction of the spring, the requisite normal contact force is achieved with low contact resistance. The plug connector is also easy to manufacture, because the ribbon cable stripped of insulation has to be inserted only up to the terminal stop 22, the retaining plate has to be brought into its final locked position of FIG. 3*b*, and the inserted unit, together with the ribbon conductor, has to be inserted into the housing 14 of the plug connector 10. These operating steps can all be fully automated, this making the plug connector simple to manufacture. Furthermore, the requisite normal contact force is readily adjusted by the bending of the spring. In the non-inserted state of the inserted unit 16, the free end 30 of the spring element 27 normally projects above the raised part 31, so that the spring element in the embodiment represented in FIG. 2 is pre-tensioned. The spring element 27 can also take a different geometric form; a region of the spring element need only project above the raised part 31 when the inserted unit 16 is not inserted and contact the conductive tracks of the inserted unit in the inserted state.

Figure 4:
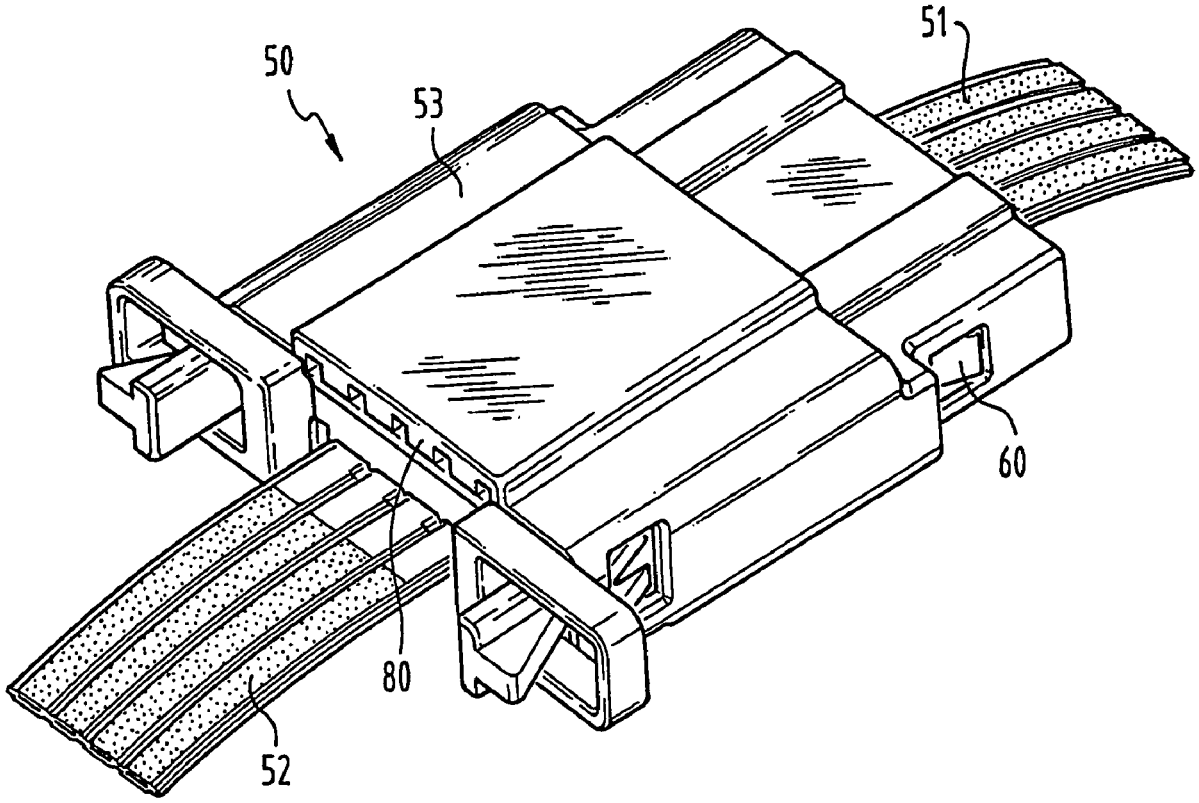
FIG. 4 shows a plug connector system of the invention in an oblique view.

Represented in FIG. 4 is an embodiment of a plug connector system 50 in accordance with the invention. The plug connector system 50, in the embodiment presented, connects a first ribbon conductor 51 to a second ribbon conductor 52. The first ribbon conductor 51 is held in place on a first holder 60 and the second ribbon conductor 52 is arranged on a second holder 80 in the housing 53 of the plug connector system.

Figure 5:
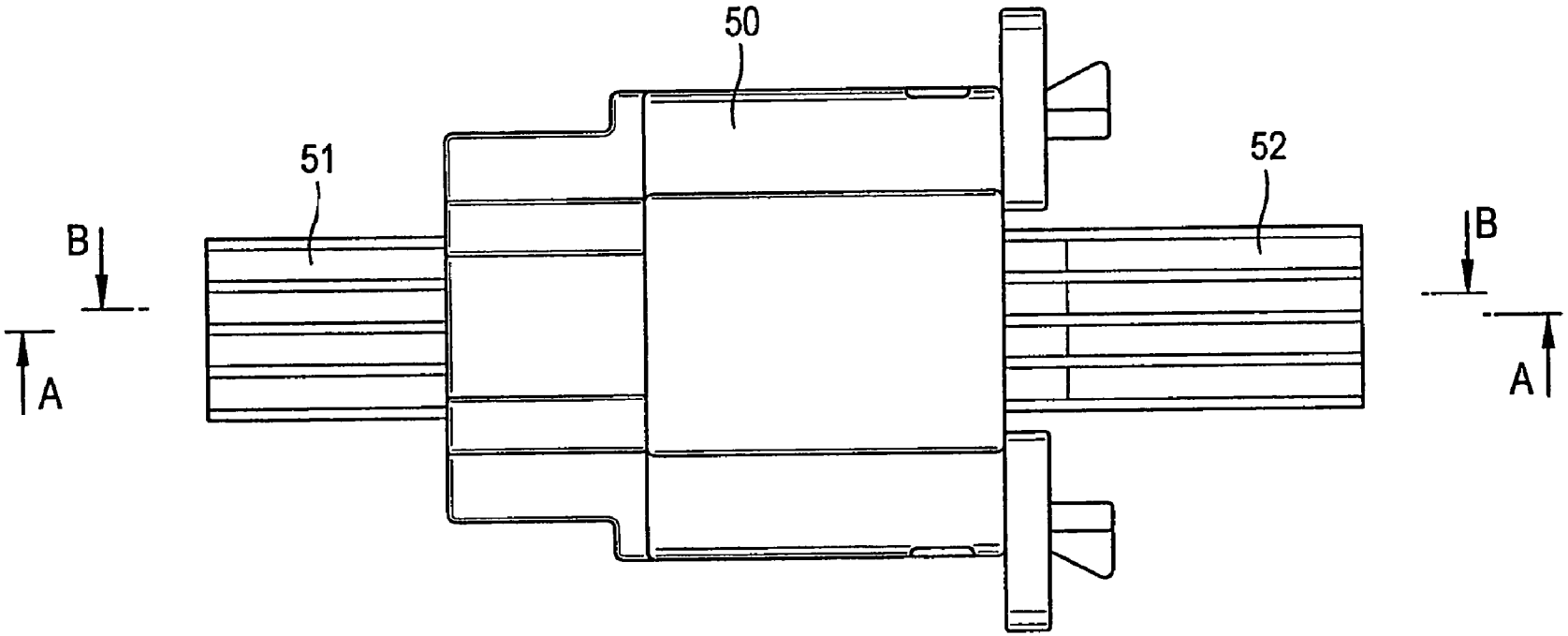
FIG. 5 shows a the plug connector system of FIG. 4 in a plan view.
Figure 6:
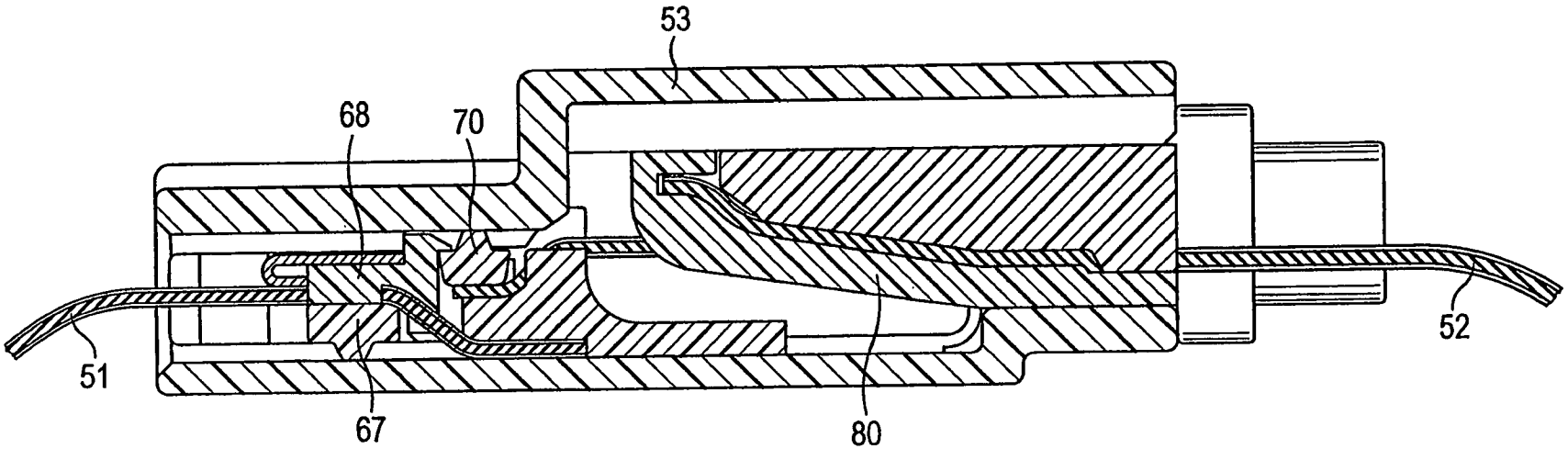
FIG. 6 shows a section along A—A of FIG. 5.

Represented in FIG. 5 is a plan view of the plug connector system 50. Represented in FIG. 6 is a section along the line A—A of FIG. 5 between two conductive tracks of the plug connector system. The first ribbon conductor 51 is placed around the first holder 60, which is inserted, as represented in FIG. 6, from the left into the housing 53 of the plug connector system 50.

Figure 8A:
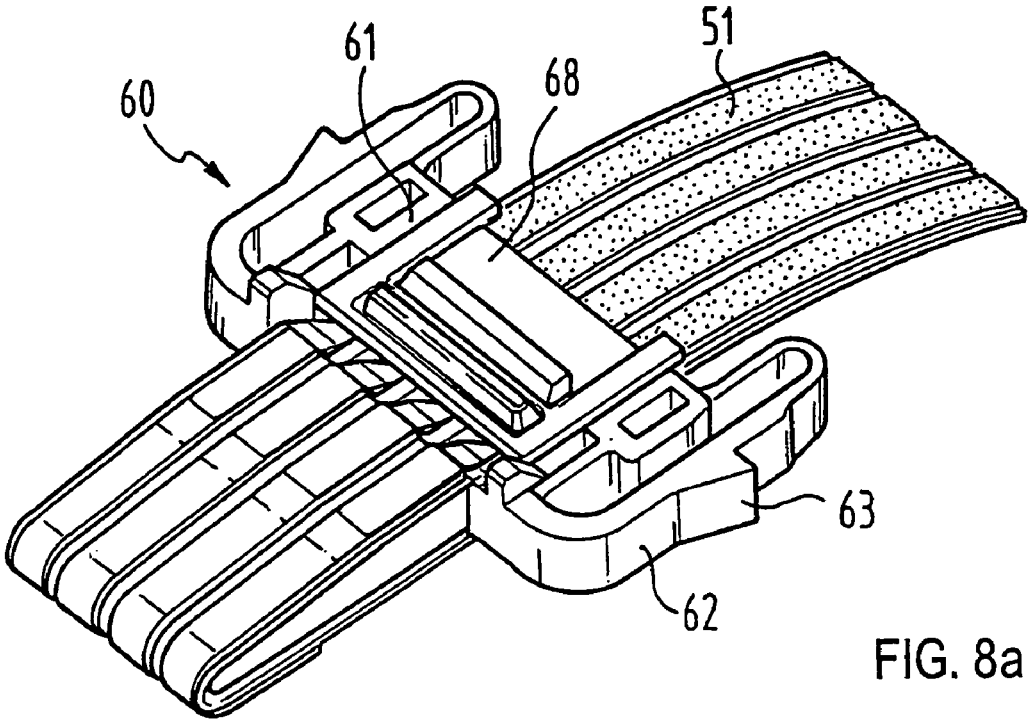
FIGS. 8*a* and 8*b* show a holder of the plug connector system of FIG. 5 in a view at an angle from above and at an angle from below.
Figure 8B:
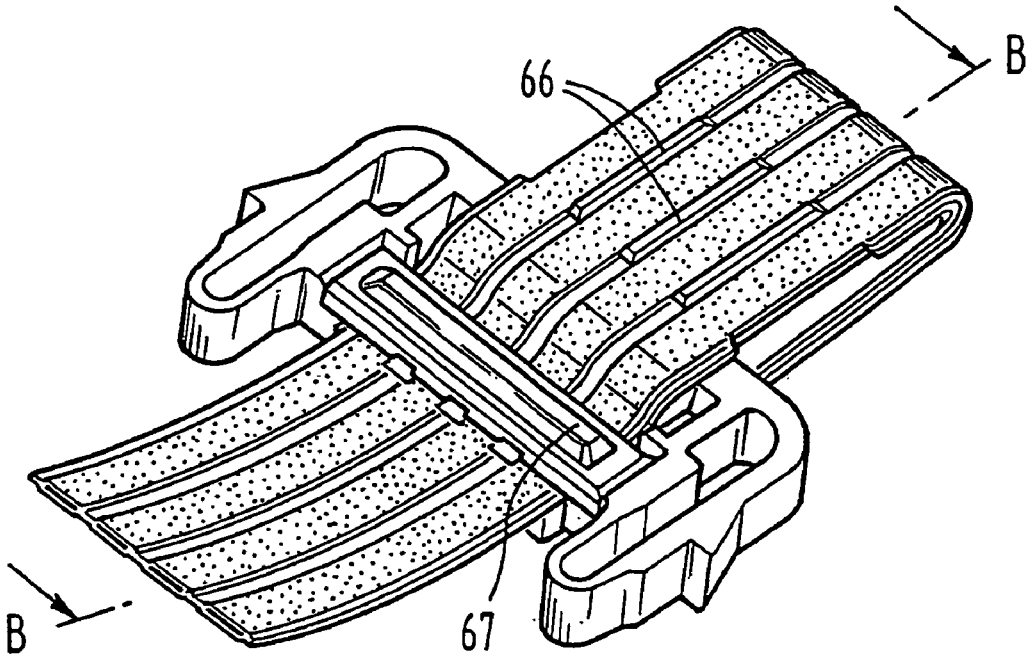
Figure 9:
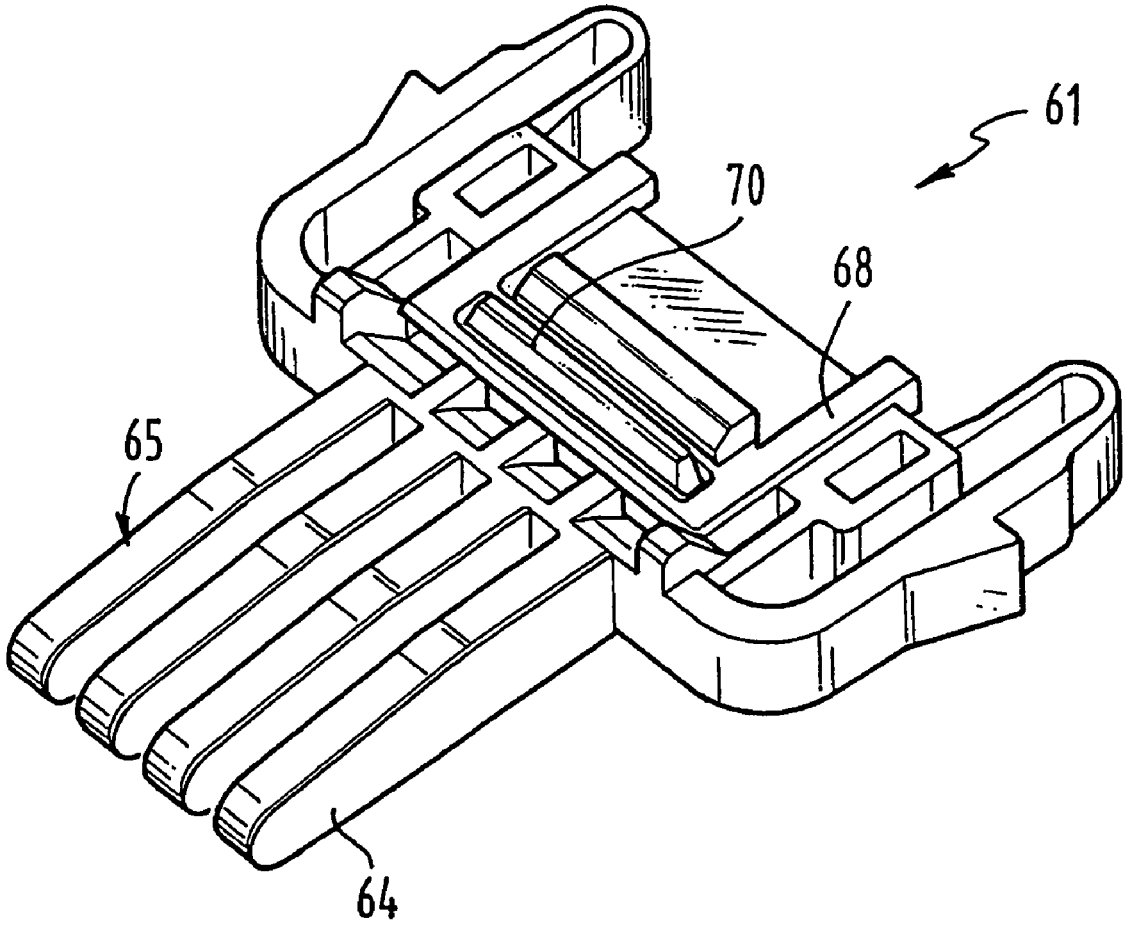
FIG. 9 shows the holder of FIG. 8 without ribbon conductor.

The first holder 60 is represented in FIGS. 8 to 11 and has a base piece 61, which has, on both sides, spring arms 62 with projections 63, with which the first holder 60 is held in place in the housing 53 of the plug connector system 50. As represented in FIG. 9, teeth 64 of a comb structure 65 are formed on the base piece 61, around which, as shown in FIG. 8*a* and FIG. 8*b*, the conductor is laid. The teeth 64 are arranged in such a way that one respective conductive track of the ribbon conductor 51 can be laid around each tooth. As represented in FIG. 8*b*, the comb structure 65 has shoulders 66 on its bottom side, these shoulders being formed as elongated projections, with which the respective conductive tracks are guided on the teeth 64.

Figure 10:
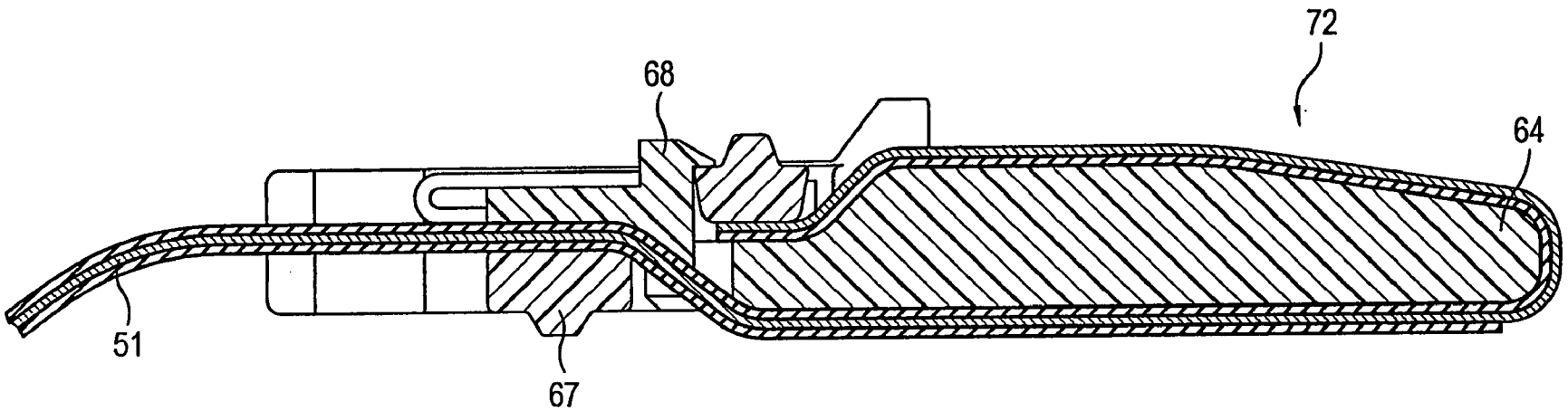
FIG. 10 shows a section along B—B of FIG. 8*b;*
Figure 11:
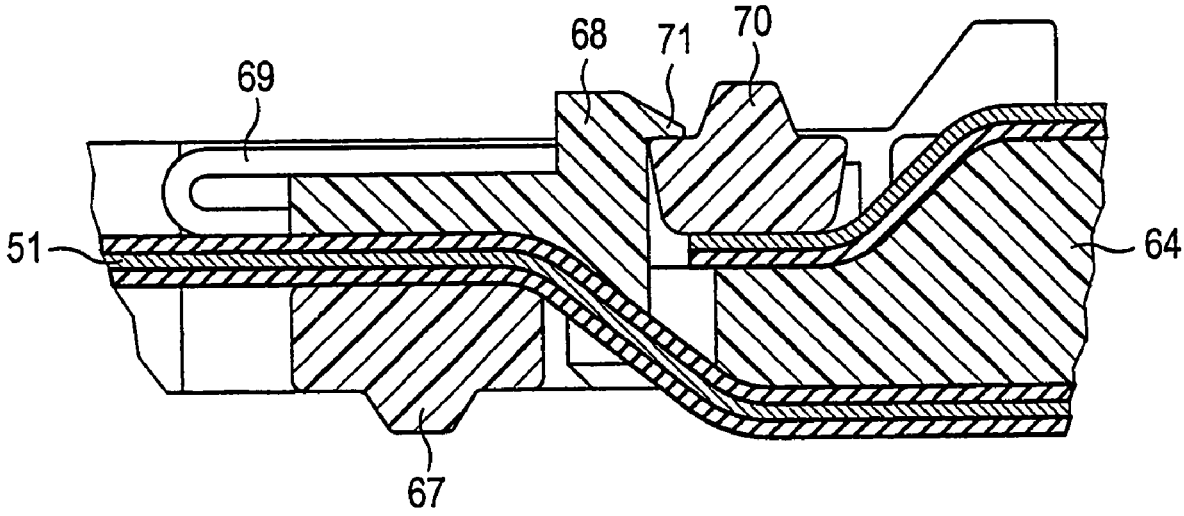
FIG. 11 shows a detailed view of FIG. 10.
Figure 12:
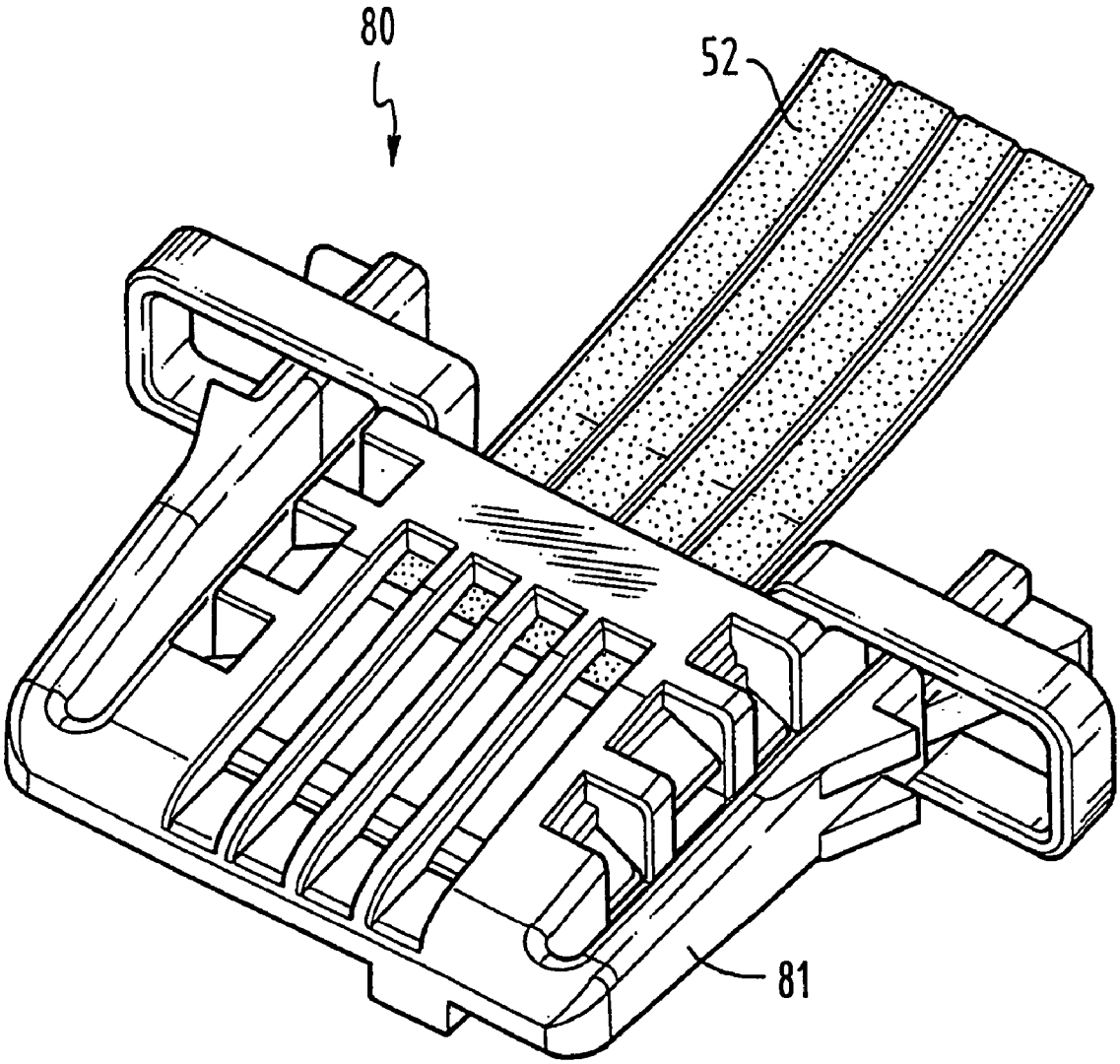
FIG. 12 shows a second holder with ribbon conductor, which is used for the plug connector system of FIG. 5.
Figure 13A:
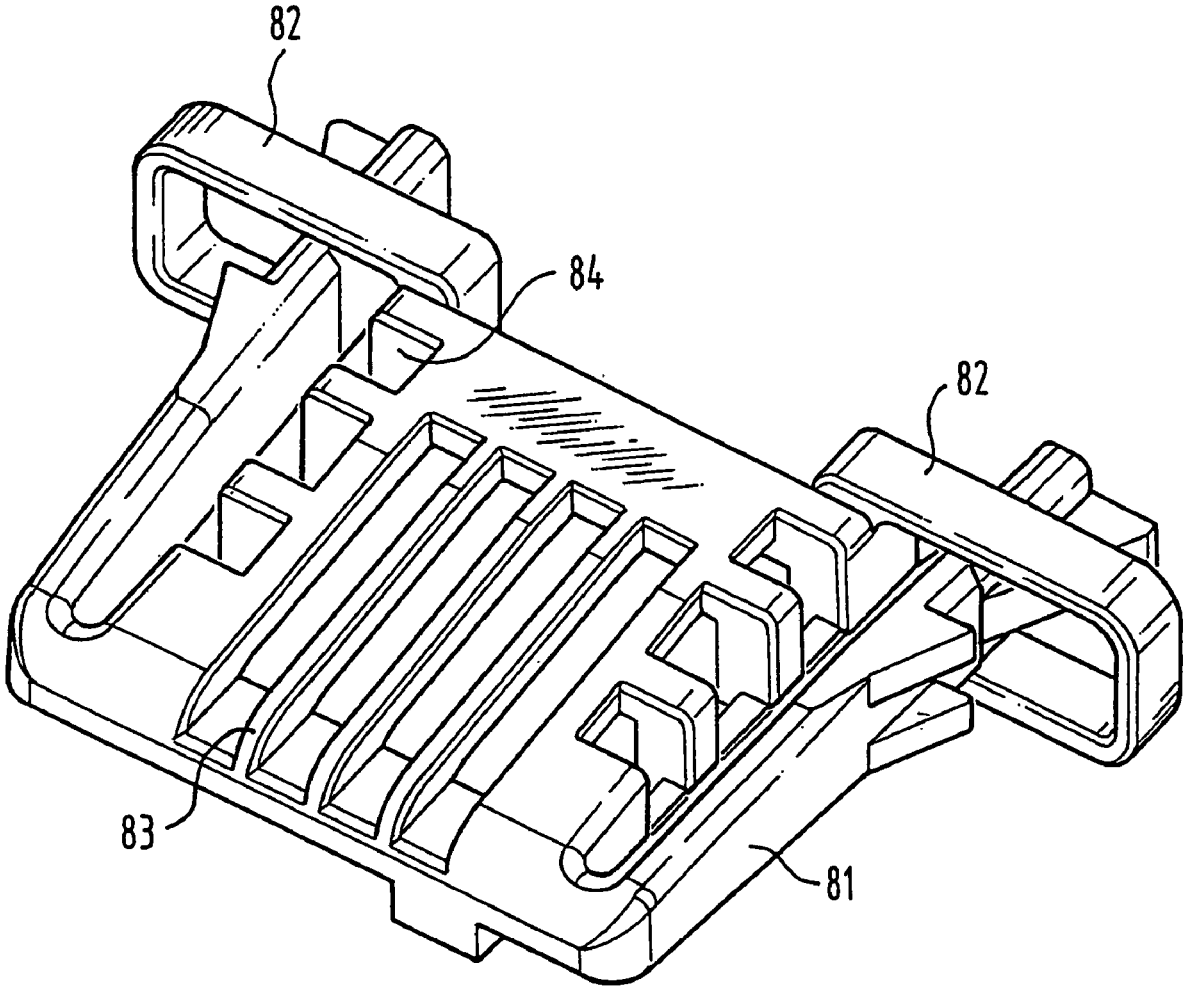
FIGS. 13*a* and 13*b* show the housing as well as the base piece of the holder shown in FIG. 12.
Figure 13B:
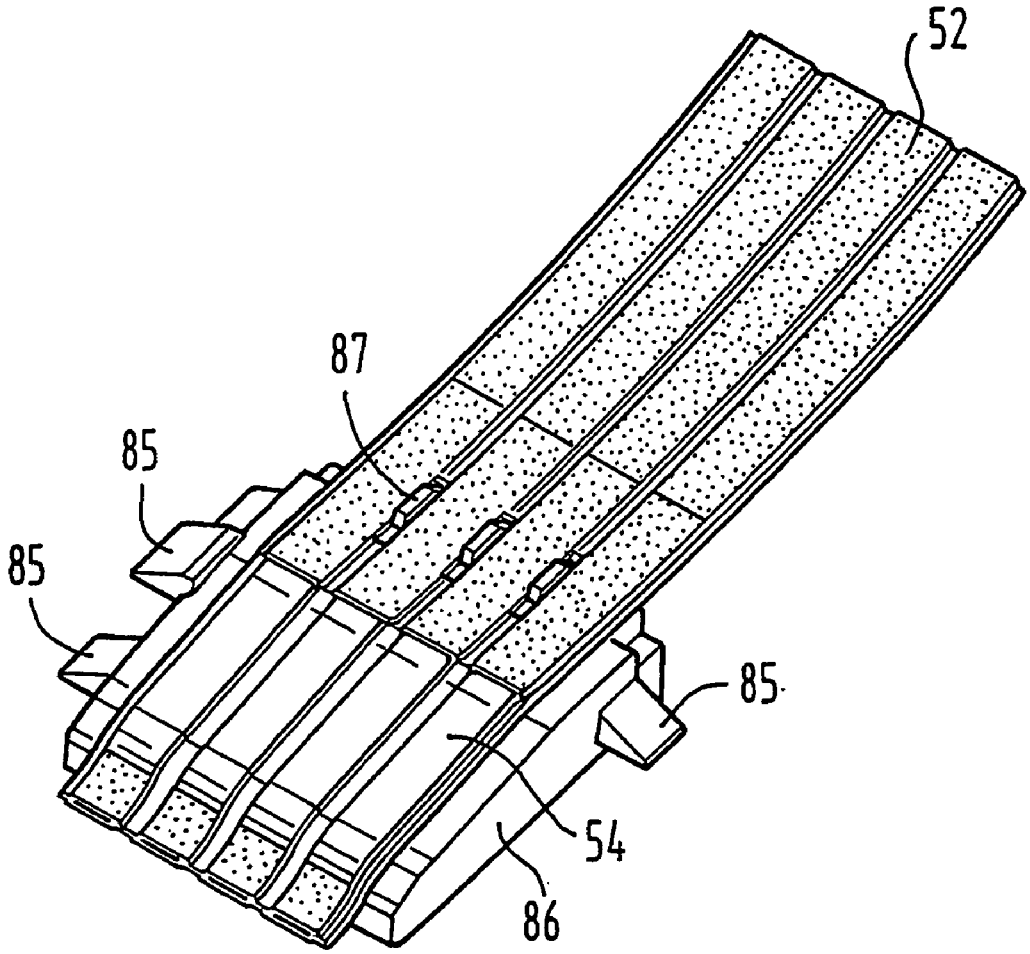

Represented in FIG. 10 is a section along the line B—B of FIG. 8*b*. The ribbon conductor 51 runs from the left and is held in place between a cross piece 67 and a cover 68, which locks with the base piece 61 laterally via catches (not shown). This cover 68 is, as represented in FIG. 11 in enlargement, arranged via a hinge 69 in a swinging manner. For introduction of the ribbon conductor 51, the hinge is open and the cover 68 is in an upper position, so that the ribbon conductor can be guided over the cross piece 67 around the teeth 64 before the end of the ribbon conductor 51 can be held in place by a fixing element 70. When the cover 68 is closed, a lip 71 of the cover 68 forms a stop, which presses the fixing element 70 with the ribbon conductor 51 lying in between against the tooth 64 and thus holds the ribbon conductor firmly in place in the first holder 60. The ribbon conductor 51 is stripped of insulation in the region in which it is placed around the teeth 64 of the comb structure 65.

Figure 7:
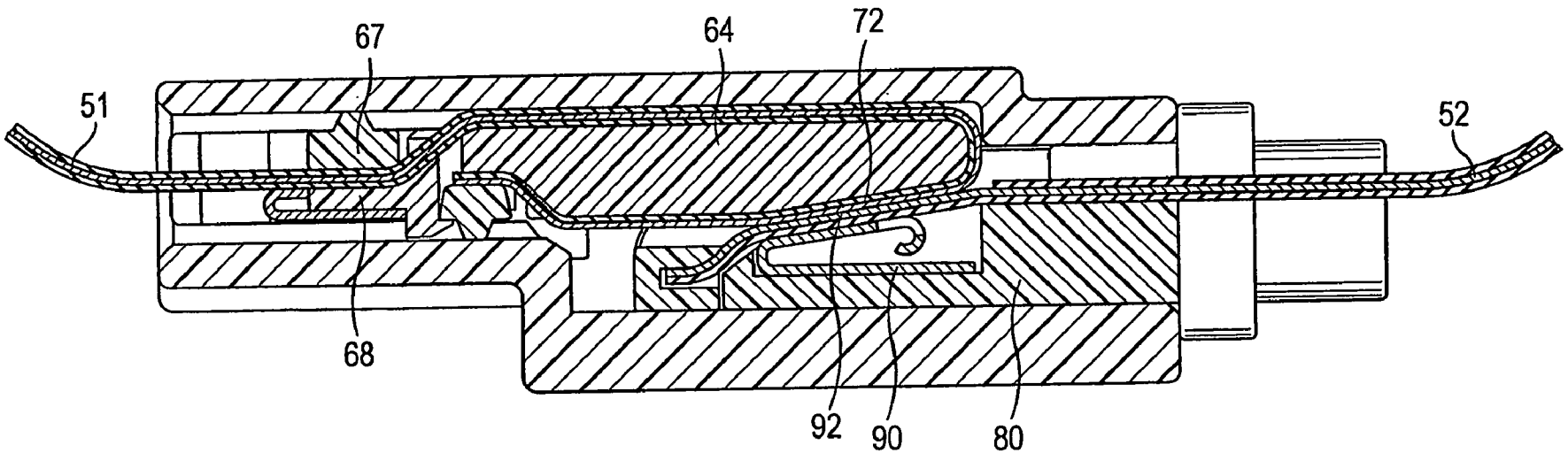
FIG. 7 shows a section along B—B of FIG. 5.

Represented in FIG. 6 is the section along A—A of FIG. 5 between two conductive tracks through the plug connector system 50. In FIG. 7, in section B—B of FIG. 5, this section is represented along a conductive track of the two ribbon conductors 51, 52. The conductor 51, held in place by the cross piece 67 and the cover 68, which serve as strain relief, goes around the tooth 64 of the comb structure 65 and contacts the second ribbon conductor 52 laid around the second holder 80.

The second holder 80 is represented in FIGS. 12 to 15. The second holder 80 has a housing 81, which corresponds essentially to the housing 19 of the inserted unit 16 represented in FIG. 3*a*. The housing 81 (see FIG. 13*a*) has, on its two long sides, a catch 82, with which it is attached to the housing 53 of the plug connector system 50. Likewise, it has ribs 83 and grooves 84, in which catch shoulders 85 engage, which are formed on a base piece 86 of the second holder at various heights for a pre-locked position and final locked position. The base piece 86 forms a holder for the second ribbon conductor 52, which is stripped of insulation at its front end, so that the conductive tracks 54 form the contact region. Arranged to guide the individual conductive tracks 54 are flanks 87, formed lengthwise on the base piece 86. The base piece represented in FIG. 13*b* is clicked onto the housing 81 and can be moved between a pre-locked position and a final locked position, which are defined by the different height of the catch shoulders 85 on the base piece 86.

Figure 14:
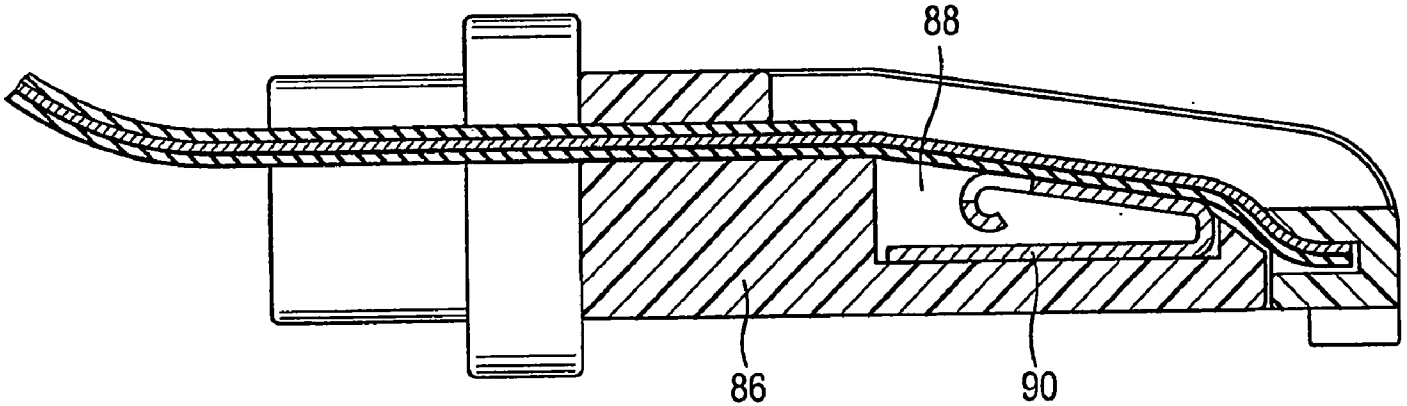
FIG. 14 shows a section along a conductive track through the holder of FIG. 12.
Figure 15:
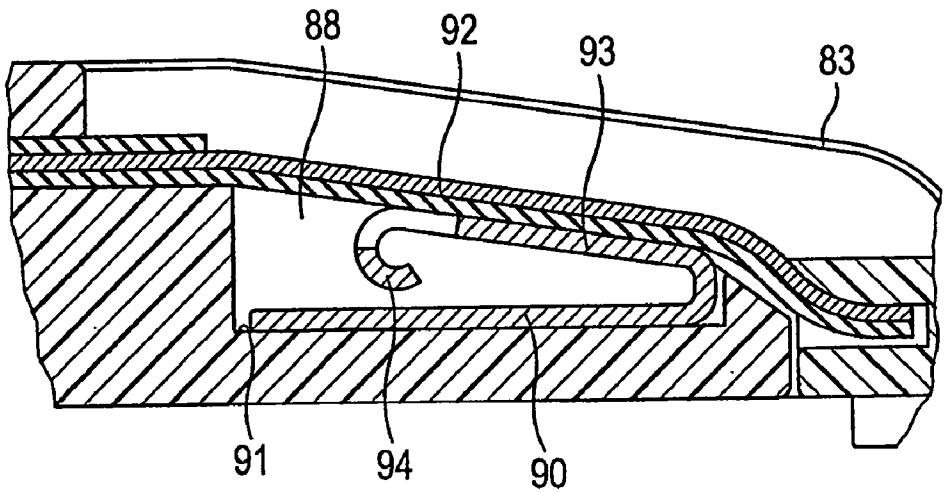
FIG. 15 shows a detailed view of FIG. 14.

As represented in FIG. 14, the base piece 86 has recesses 88, in each of which a spring element 90 is arranged. As represented in FIG. 15 in enlargement, the spring element 90 lies on the bottom 91 of the recess 88, is bent back, and terminates in a free end 93, which presses the ribbon conductor 52 from behind with its contact surface 92 against the ribs 83. The force with which the ribbon conductor 52 is pressed against the ribs 83 is influenced by the selection of the spring geometry as well as the choice of materials of the spring element 90. The spring further has, at its free end 93, a semicircular bend 94, which stops the movement of the free end downward when the bend 94 comes to rest on the lower part of the spring element.

As represented in FIG. 7, the teeth 64, surrounded by the first ribbon conductor 51, engage between the ribs 83 of the second holder 80 and press the stripped first ribbon conductor 51 with the contact surface thereof 72 against the contact surface 92 of the ribbon conductor 52, which is pressed by means of the spring element 90 against the ribs 83.

By means of the geometric selection of the teeth and the choice of the spring geometry and material of the spring element 90, it is possible then to adjust the plug connector system in such a way that the desired normal contact force lies between 2 and 4 N, so that an optimal contacting with low contact resistance results, while the penetration depth into the conductor is not so large that the latter is damaged.

Preferably, the second holder is constructed in such a way that, for each conductive track 54, there is provided a recess 88 with a spring element 90, the spring element 90 pressing the conductor 52 between two ribs 83.

A repeatedly releasable system, for which conductive tracks of various ribbon conductors can be connected with good contact resistance and small spatial requirement is made available by means of the present plug connector system. For example, the second holder can be modified in such a way that the conductive tracks of the second ribbon conductor have a differing width. Overall, a contact with defined contact force is achieved through two simple insertion motions of the two holders.

The invention claimed is:

1. A plug connector system for connecting two ribbon conductors, with a first holder, on which the first ribbon conductor is held in place, a second holder on which the second ribbon conductor is held in place, which has at least one spring element that affords a normal contact force for connecting the two ribbon conductors, is hereby characterized in that the first holder has a comb structure, wherein the first ribbon conductor is placed around teeth of the comb structure, which engages ribs formed on the second holder and connects the two ribbon conductors to each other, wherein the at least one spring element presses the second ribbon conductor against the ribs.

2. The plug connector system according to claim 1, further characterized in that the at least one spring element is arranged in at least one recess formed in the second holder.

3. The plug connector system according to claim 2, further characterized in that the second ribbon conductor is arranged between the spring element, arranged in the recess, and the ribs.

4. The plug connector system according to claim 1, further characterized in that a conductive track of the first ribbon conductor lies around each tooth of the comb structure, a shoulder being formed between the teeth for guiding the respective conductive tracks.

5. The plug connector system according to claim 1, further characterized in that the ribbon conductor in the first holder is held in place between a cross piece that runs transverse to the conductive tracks and a hinge, which can be swung from a prelocking position into a final locking position and which, at the same time, holds the end of the ribbon conductor in the final locking position.

6. The plug connector system according to claim 1, further characterized in that a respective spring element is provided between two ribs, which presses a respective conductive track of the second ribbon conductor in the direction of the first ribbon conductor laid around the teeth.

7. A plug connector system for connecting a first ribbon conductor with a second ribbon conductor, the plug connector system comprising:

a first holder, wherein the first holder has a comb structure, wherein the first ribbon conductor is held in place on the first holder with the first ribbon conductor placed around teeth of the comb structure; and a second holder, wherein the second ribbon conductor is held in place on the second holder, wherein the second holder comprises ribs and at least one spring element pressing the second ribbon conductor towards the ribs, wherein, when the first and second holders are connected to each other, teeth of the comb structure extend between the ribs of the second holder, and wherein the at least one spring element presses the second ribbon conductor against the first ribbon conductor.

8. The plug connector system according to claim 7, wherein the at least one spring element comprises a respective leg for each conductive track of the second ribbon conductor, which respective legs press against the second ribbon conductor at each respective one of the conductive tracks.

9. The plug connector system according to claim 7, wherein each of the at least one spring element presses a conductive track of the second ribbon conductor between two of the ribs.

* * * * *